US006744027B2

(12) United States Patent
Fathi et al.

(10) Patent No.: US 6,744,027 B2
(45) Date of Patent: Jun. 1, 2004

(54) MICROWAVE THAWING APPARATUS AND METHOD

(75) Inventors: Zakaryae Fathi, Cary, NC (US); Robert J. Lauf, Oak Ridge, TN (US); April D. McMillan, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 71 days.

(21) Appl. No.: 10/120,860

(22) Filed: Apr. 11, 2002

(65) Prior Publication Data

US 2003/0192884 A1 Oct. 16, 2003

(51) Int. Cl.[7] ..... H05B 6/80
(52) U.S. Cl. ..... 219/703; 219/729
(58) Field of Search ..... 219/703, 729, 219/756, 733, 736, 704, 706, 709, 693, 687, 754, 762, 696, 750, 751; 426/107, 234, 243, 115, 112, 120, 124, 110, 113, 130, 86, 393, 241; 34/201, 259

(56) References Cited

U.S. PATENT DOCUMENTS 3,336,142 A * 8/1967 Lawson ..... 426/241
3,505,490 A * 4/1970 Name not available ..... 219/754
4,004,122 A * 1/1977 Hallier ..... 219/697
4,233,325 A * 11/1980 Slangan et al. ..... 426/107
4,954,679 A 9/1990 Harms et al.
5,073,167 A 12/1991 Carr et al.
5,180,896 A 1/1993 Gibby et al.
5,374,811 A 12/1994 Kiel et al.
5,616,268 A 4/1997 Carr
5,683,381 A 11/1997 Carr et al.
5,690,614 A 11/1997 Carr et al.
5,919,218 A 7/1999 Carr
6,146,359 A 11/2000 Carr et al.

* cited by examiner

*Primary Examiner*—Quang T. Van
(74) *Attorney, Agent, or Firm*—Joseph A. Marasco

(57) ABSTRACT

An apparatus for thawing a frozen material includes: a microwave energy source; a microwave applicator which defines a cavity for applying microwave energy from the microwave source to a material to be thawed; and a shielded region which is shielded from the microwave source, the shielded region in fluid communication with the cavity so that thawed material may flow from the cavity into the shielded region.

58 Claims, 9 Drawing Sheets

MICROWAVE THAWING APPARATUS AND METHOD

CROSS-REFERENCE TO RELATED APPLICATIONS

This application is related to another application filed on even date herewith and entitled "MICROWAVE THAWING PACKAGE AND METHOD", accorded U.S. patent application Ser. No. 10/120,753, the entire disclosure of which is incorporated herein by reference.

The United States Government has rights in this invention pursuant to contract no. DE-AC05-00OR22725 between the United States Department of Energy and UT-Battelle, LLC.

FIELD OF THE INVENTION

The present invention relates to devices and methods for thawing frozen materials by exposing same to electromagnetic energy, and more particularly to such devices and methods wherein thawed liquid is removed from exposure to the energy to prevent overheating the liquid.

BACKGROUND OF THE INVENTION

Many heat sensitive materials are frozen to prolong storage life. These include foodstuffs, pharmaceuticals, and particularly blood and blood products. It is often desirable to thaw these materials quickly, especially blood needed in emergency situations. At the same time, it is well known that it is very difficult to thaw frozen materials by microwave heating in a controlled and reproducible way, because the loss tangent of water is so much greater than that of ice. Once a small portion of the material is melted, that portion rapidly absorbs additional microwave energy and begins cooking.

In the field of microwave radiation, it is well known that microwave ovens may be constructed to operate at either fixed or variable frequency. Owing to the coupling ability of 2.45 GHz microwaves to water, this frequency is often used for cooking foods, drying, and other purposes wherein the principal material to be acted upon is water. Most commercial units operate at frequency range of 2.45 GHz +/−25 MHz, and some as hi +/−50 However, it is well known that a multimode cavity operating at fixed frequency will display significant nonuniformities in the spatial power density owing to the formation of standing waves (or the excitation of only a small number of microwave modes within the cavity).

Recently, the use of frequency sweeping over a wide range as a means of mode stirring has been demonstrated and patented (Bible et al., U.S. Pat. No. 5,321,222). Modeling results and experimentation have shown that for typical multimode applicator cavities a bandwidth of about +/−5% of a center frequency provides a relatively uniform power density because of the superposition of many independent microwave modes (Bible et al. U.S. Pat. No. 5,961,871). Electronic frequency sweeping may be performed at a high rate of speed, thereby creating a much more uniform time-averaged power density throughout the furnace cavity. The desired frequency sweeping may be accomplished through the use of a variety of microwave electron devices. A helix traveling wave tube (TWT), for example, allows the sweeping to cover a broad bandwidth (e.g., 2 to 8 GHz) compared to devices such as the voltage tunable magnetron (2.45+0.05 GHz). Other devices such as klystrons and gyrotrons have other characteristic bandwidths, which may be suitable for some applications.

In fixed frequency ovens, attempts have been made at mode stirring, or randomly deflecting the microwave "beam", in order to break up the standing modes and thereby fill the cavity with the microwave radiation. One such attempt is the addition of rotating fan blades at the beam entrance of the cavity (Mizutani et al. U.S. Pat. No. 4,629,849). Alternatively, rotating feed horns (Kaneko et al. U.S. Pat. No. 4,176,266) and multiple feed horns (Jurgensen U.S. Pat. No. 3,916,137) have been described. None of these approaches creates a substantially uniform microwave power density within a "small" multimode cavity. Mechanical mode stirring devices do not in general provide enough of a physical perturbation and there is a limit to how fast they can be moved. Using multiple feeds becomes impractical when the number of feeds exceeds more than a few, and this is generally not adequate for true power uniformity within the cavity.

Another method used to overcome the adverse effects of standing waves is to intentionally create a standing wave within a single-mode cavity such that the workpiece may be placed at the location determined to have the highest power (the hot spot). Thus, only that portion of the cavity in which the standing wave is most concentrated will be used.

Other devices have been produced to change the parameters of the heating process of selected materials. Typical of the art are those devices disclosed in the following U.S. Patent:

| Patent No. | Inventor (s) | Issue Date |
|---|---|---|
| 3,611,135 | D. L. Margerum | Oct. 5, 1971 |
| 3,916,137 | P. D. Jurgensen | Oct. 28, 1975 |
| 4,144,468 | G. Mourier | Mar. 13, 1979 |
| 4,176,266 | Y. Kaneko et al. | Nov. 27, 1979 |
| 4,196,332 | A. MacKay B, et al. | Apr. 1, 1980 |
| 4,340,796 | M. Yamaguchi, et al. | Jul. 20, 1982 |
| 4,415,789 | T. Nobue, et al. | Nov. 15, 1983 |
| 4,504,718 | H. Okatsuka, et al. | Mar. 12, 1985 |
| 4,593,167 | O. K. Nilssen | Jun. 3, 1986 |
| 4,629,849 | I. Mizutani et al. | Dec. 16, 1986 |
| 4,777,336 | J. Asmussen | Oct. 11, 1988 |
| 4,825,028 | P. H. Smith | Apr. 25, 1988 |
| 4,843,202 | P. H. Smith, et al. | Jun. 27, 1989 |
| 4,866,344 | R. I. Ross, et al. | Sept. 13, 1989 |
| 4,939,331 | B. Berggren, et al. | Jul. 3, 1990 |
| 5,321,222 | D. W. Bible et al. | Jun. 14, 1994 |
| 5,700,326 | Takatsu et al. | Dec. 23, 1997 |
| 5,961,871 | D. W. Bible et al. | Oct. 5, 1999 |

As previously mentioned, Bible et al. have described how frequency sweeping over a selected bandwidth, typically 5%, could establish a substantially uniform microwave power distribution within the cavity by the superposition of many hundreds of microwave modes. Nevertheless, none of the aforementioned approaches can completely address the fundamental difficulty of microwave thawing, namely, the large difference in dielectric loss between water and ice. The large increase in loss tangent upon melting creates an inherently unstable heating process in which the first volume of material to melt begins to absorb power selectively, rapidly leading to localized thermal runaway.

OBJECTS OF THE INVENTION

Accordingly, it is therefore an object of this invention to provide a microwave or other electromagnetic energy heating apparatus in which a frozen material may be subjected to a controlled application of the energy.

It is another object of the present invention to provide a microwave or other electromagnetic energy heating apparatus in which one may control the absorption of the energy within a frozen material to selectively begin melting the material at predetermined areas.

It is another object of the present invention to provide a microwave or other electromagnetic energy heating apparatus in which one may protect already-melted liquid from further exposure to the energy by providing a shielded region for the thawed liquid.

It is a further object of the present invention to provide a microwave or other electromagnetic energy heating apparatus in which one can manage the flow of liquid after melting to prevent the entrapment of liquid in areas that are exposed to the energy.

It is yet another object of the present invention to provide a method of applying a controlled concentration of microwave or other electromagnetic energy to a container of frozen material.

It is another object of the present invention to provide a method of controlling the absorption of microwave or other electromagnetic energy within a frozen material to selectively begin melting the material at predetermined areas.

Yet another object of the present invention is to provide a method of thawing in which already-melted liquid is protected from further exposure to microwave or other electromagnetic energy.

It is a further object of the present invention to provide a method for thawing in which the flow of liquid after melting is controlled to prevent the entrapment of liquid in areas that are exposed to microwave or other electromagnetic energy.

Further and other objects of the present invention will become apparent from the description contained herein.

SUMMARY OF THE INVENTION

In accordance with one aspect of the present invention, the foregoing and other objects are achieved by an apparatus for thawing a frozen material. The apparatus includes: an electromagnetic energy source; an energy applicator which defines a cavity for applying microwave energy from the microwave source to a material to be thawed; and a shielded region which is shielded from the energy source, the shielded region in fluid communication with the cavity so that thawed material may flow from the cavity into the shielded region.

In accordance with another aspect of the present invention, an apparatus for thawing of selected materials includes: a multimode microwave applicator cavity; a microwave source adapted for sweeping the frequency of microwave energy introduced into the cavity over a usable bandwidth of at least +/−2% of a center frequency so that the microwave power density within the cavity is substantially uniform; and a shielded region which is shielded from the microwave source, the shielded region in fluid communication with the cavity so that thawed material may flow from the cavity into the shielded region.

In accordance with a further aspect of the present invention, a method of thawing selected materials includes the steps of: providing an electromagnetic energy source; an energy applicator which defines a cavity for applying energy from the energy source to a material to be thawed; and a shielded region which is shielded from the energy source, the shielded region in fluid communication with the cavity so that thawed material may flow from the cavity into the shielded region; placing a material to be thawed into the microwave applicator cavity; and introducing microwave energy into the applicator cavity to thaw the material so that thawed liquid flows from the cavity into the shielded region.

In accordance with another aspect of the present invention, a method for microwave-assisted thawing of selected materials includes the steps of: providing a multimode microwave applicator cavity; a microwave source adapted for sweeping the frequency of microwave energy introduced into the cavity over a usable bandwidth of at least +/−2% of a center frequency so that the microwave power density within the cavity is substantially uniform; and a shielded region which is shielded from the microwave source, the shielded region in fluid communication with the cavity so that thawed material may flow from the cavity into the shielded region; placing a material to be thawed into the microwave applicator cavity; and introducing microwave energy into the applicator cavity to thaw the material so that thawed liquid flows from the cavity into the shielded region.

BRIEF DESCRIPTION OF THE DRAWINGS

Like reference numerals are used for like elements in the drawings.

For a better understanding of the present invention, together with other and further objects, advantages and capabilities thereof, reference is made to the following disclosure and appended claims in connection with the above-described drawings.

DETAILED DESCRIPTION OF THE INVENTION

The present invention is designed to provide apparatus and methods for controlled thawing of frozen materials by electromagnetic energy while preventing thermal runaway in already-melted material. Some applicable processes include thawing of foodstuffs, pharmaceuticals, blood and blood products, biological tissue, other biological and/or chemical materials. Electromagnetic energy includes microwave, radio-frequency (RF), and infra-red (IR) types of energy.

Figure 1:
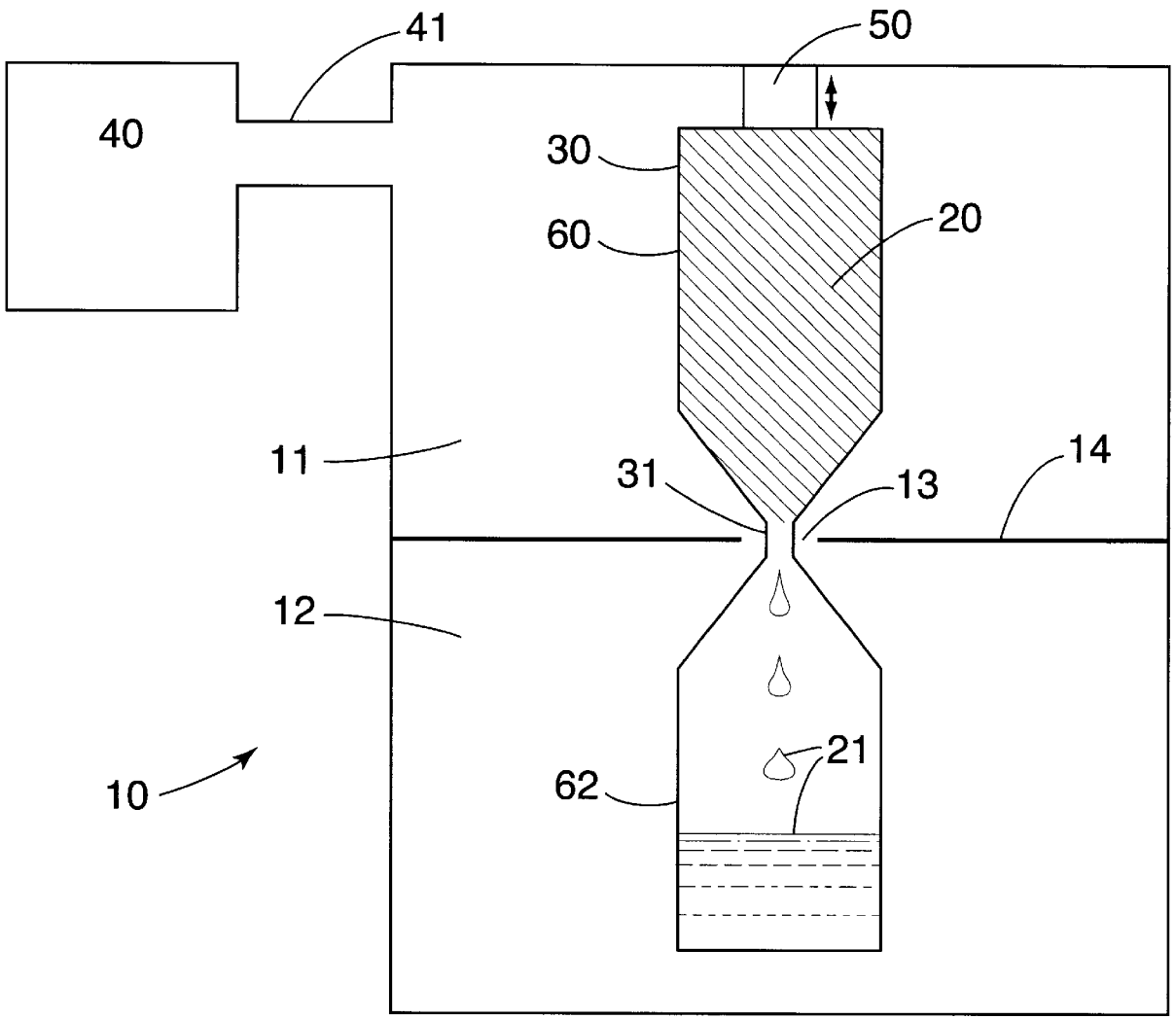
FIG. 1 is a schematic cross-sectional view of an embodiment of the present invention wherein an upper applicator cavity provides microwave heating while a lower, shielded cavity protects thawed liquid from further heating.

Referring to FIG. 1, an apparatus 10 for thawing frozen material 20 comprises an upper, microwave applicator enclosure (cavity) 11 and a lower, shielded cavity 12 therebelow. An opening 13 is provided in a microwave shield 14 between the two cavities. The opening 13 should be small enough to prevent significant leakage of microwave energy into the shielded cavity 12. A microwave source 40 provides microwave energy to the microwave applicator cavity 11 through a waveguide 41.

A package 30 containing solid (frozen) material 20 is placed in the microwave applicator cavity 11. The package 30 further has a narrow section, tube or other draining means 31 to allow for thawed (melted) liquid 21 to flow down into the shielded cavity 12 to shield the liquid 21 from further microwave heating. The draining means 31 may be subjected to supplemental heating in order to prevent blockage thereof by frozen material (not illustrated). This may be accomplished by wrapping the draining means 31 with a microwave susceptor or by placing an auxiliary heater near or in contact with the draining means 31.

Some means of catching and holding the liquid 21 in the shielded cavity 12 is necessary. A simple catching means is an open-top vessel (not illustrated). FIG. 1 shows a more preferable embodiment wherein the package 30 is a sealable, roughly hourglass shaped unit to maintain integrity and/or sterility of the material being thawed, and/or to maintain cleanliness and prevent contamination of the apparatus 10. Such a package comprises an upper, first section 60 for placement in the microwave applicator cavity 11, a lower, second section 62 for placement in the shielded cavity 12, and a narrow section 31 therebetween to serve as a draining means.

The present invention may be carried out in a number of ways while preserving the essential feature of providing a shielded area to collect liquids, thereby preventing overheating. The opening 13 may simply be an aperture between the two cavities, to accommodate a tube or other draining means. Alternatively, to accommodate the two-part container shown in FIG. 1, a preferable design is to make the opening 13 in the form of a slot that extends to the front opening of the cavity, so that when the cavity is opened the two-part bag may be slipped in or out. Further simple modifications such as a hinged flap cover can be added to minimize microwave leakage through a slotted opening 13, if desired. Alternatively, as will be further discussed, some controlled leakage between the two cavities might be desired in some circumstances. In either case, skilled artisans will easily see how this structure may be configured in any number of simple ways to achieve the desired results without undue experimentation. For example, the shield 14 may be split into two components, with one component connected to the door of the cavity, making it easier to remove the two-part container when the door is opened.

Moreover, the package 30 may be provided with optional features in order to promote the expeditious removal of liquid from the microwave applicator cavity 11 into the shielded cavity 12, helping to insure that liquid cannot become trapped in the microwave applicator cavity 11, which, as has been explained hereinabove, could lead to runaway heating and damage to the material. For example, the package 30 may be provided with features as discussed in the above-referenced copending patent application. Such features include liquid flow management features, microwave absorption features and microwave shielding features.

An optional mechanical agitation means 50 may be provided in connection with the microwave applicator cavity 11 to agitate the first section 60 of the package 30 to enhance the downward flow of liquid and prevent locally isolated pockets of liquid that might overheat. Agitation can be carried out by any of various conventional means, for example, by vibrating, shaking, or agitating the entire package at low frequencies, or by contacting the first section 60 of the package 30 with an ultrasonic transducer or the like. The only limitation contemplated for such a feature would be that, for delicate materials such as blood, the agitation should not be so violent as to be pernicious to the integrity of the material undergoing the thawing process. The agitation process can be comprised of motion in any direction: vertical, as shown by arrow in FIG. 1, horizontal, rotational, or any simultaneous or sequential combination of different motions.

Figure 3:
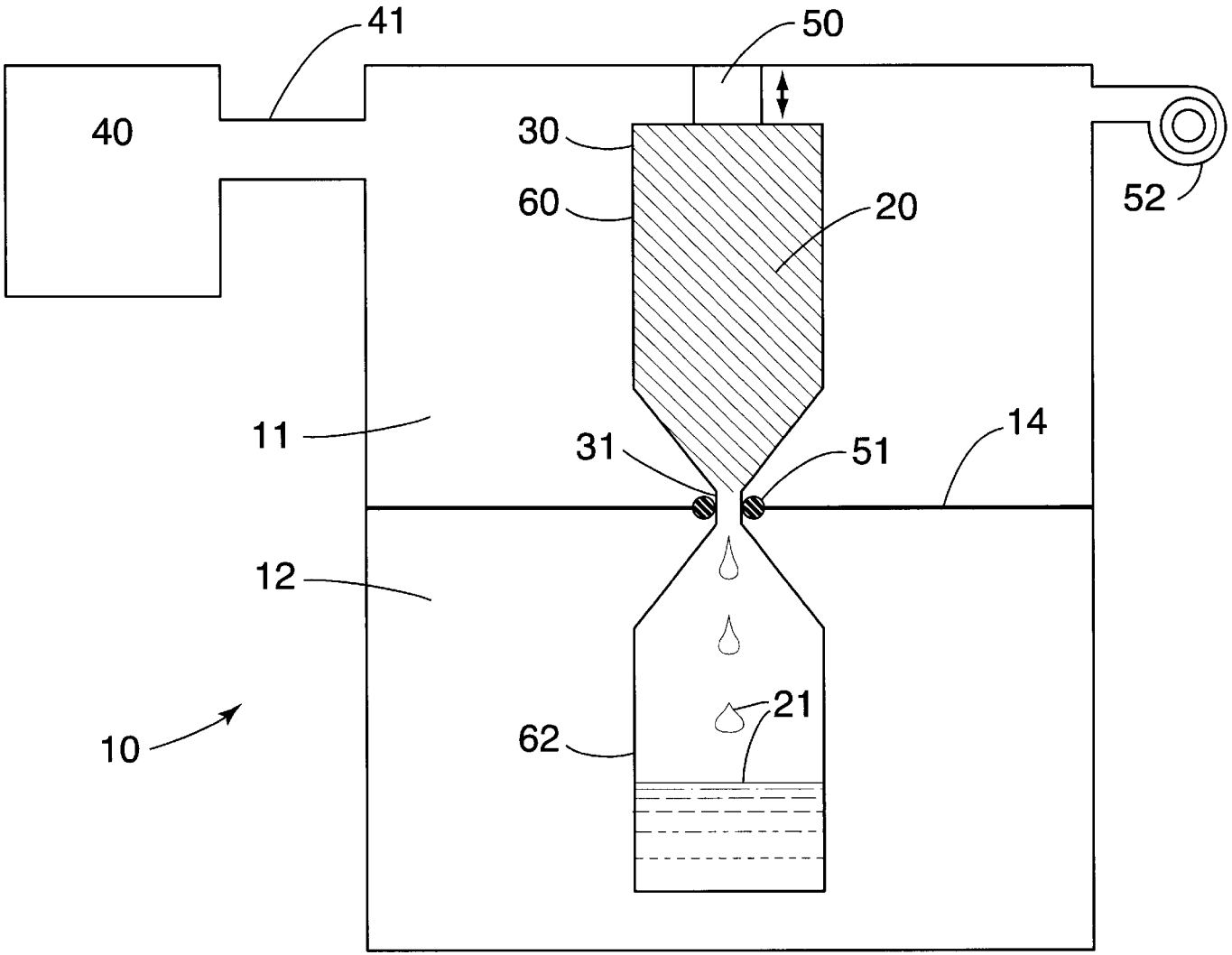
FIG. 3 is a schematic cross-sectional view of an embodiment of the present invention that is similar to that shown in FIG. 1, but with some optional features included.

Another means of enhancing the downward flow of liquid is shown in FIG. 3, where a pump 52 is provided to pressurize the microwave applicator cavity 11 relative to the shielded cavity 12. A seal 51 is provided to prevent or minimize airflow between the microwave applicator cavity 11 and shielded cavity 12. The seal 51 can be any conventional sealing means, such as an O-ring, grommet, molding, polymer foam, putty, and the like. As the solid material 20 melts, the flexible package 30 tends to collapse under the imposed hydrostatic pressure in 11 thereby forcing liquid 21 to flow downwardly through the draining means 13 into the second section 62 of the package 30. It will be appreciated that the same effect may be achieved by keeping the microwave applicator cavity 11 at ambient pressure and establishing a partial vacuum in the shielded cavity 12 or in the second section 62 of the package 30, provided the viscosity of liquid 21 is not excessive. Moreover, it will be appreciated that various embodiments of the present invention may be oriented in any position, including a horizontal position, as long as there is means available for forcing or enhancing the flow of liquid 21 into the second section 62 of the package 30.

Figure 2:
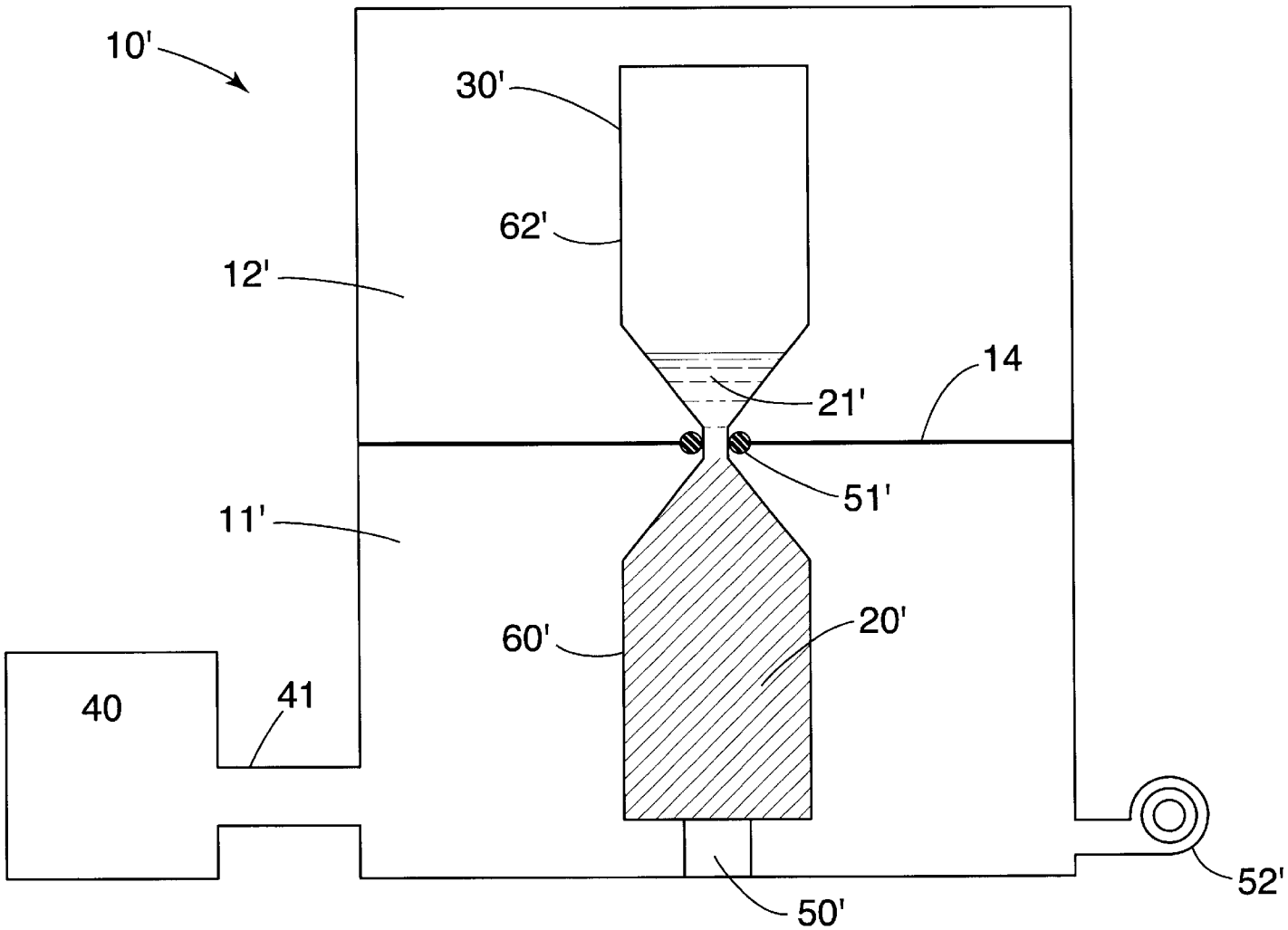
FIG. 2 is a schematic cross-sectional view of an inverted embodiment of the present invention, which is suitable for situations in which the liquid density is less than the solid density of the material undergoing the thawing process.

The invention is applicable to any thawing situation in which the liquid phase has substantially greater dielectric loss than the solid phase. For cases in which the density of the liquid phase is less than that of the solid phase (many polymers, for example) it will be appreciated that the embodiments shown in FIGS. 1 and 3 should be essentially inverted. Looking now to FIG. 2, an inverted embodiment is shown. A microwave source 40 provides microwave energy to the lower, microwave applicator cavity 11' through a waveguide 41, and the upper cavity 12' is shielded.

Supplemental means for forcing the fluid from a lower, first section 60' of the package 30' into an upper, second section 62' thereof, as similarly described hereinabove, is preferably employed in the inverted embodiments (FIG. 2) of the present invention. This can be easily accomplished by maintaining a few PSI (for example, in the range of 1–30 PSI) positive air pressure in the microwave applicator chamber 11', which compresses the first section 60' of the package 30' to cause thawed fluid 21' to flow upwardly into the second section 62' of the package 30'. A pump 52' is provided to pressurize the microwave applicator cavity 11' relative to the shielded cavity 12' and a seal 51 is provided to prevent or minimize airflow between the microwave applicator cavity 11' and shielded cavity 12'. Thus, as solid 20' melts, the first section 60' of the flexible package 30' tends to collapse under the imposed hydrostatic pressure in the microwave applicator cavity 11' thereby forcing liquid 21' upwardly into the second section 62' of the package 30'. It will be appreciated that the same effect may be achieved by keeping the microwave applicator cavity 11' at ambient pressure and establishing a partial vacuum in the shielded cavity 12' or in the second section 62' of the package 30, provided the viscosity of liquid 21' is not excessive.

Figure 4:
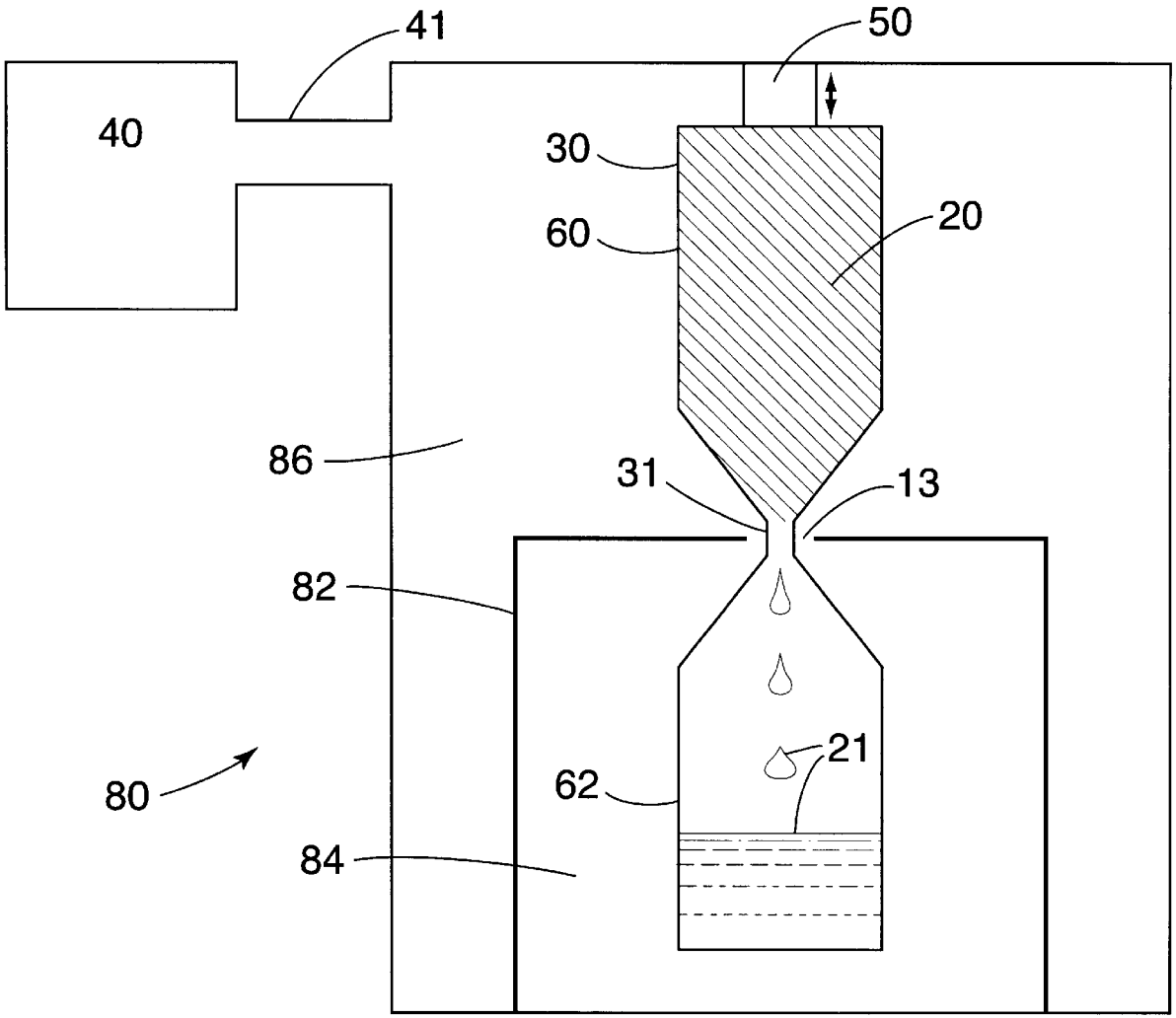
FIG. 4 is a schematic cross-sectional view of an embodiment of the present invention wherein a microwave-shielding partition is inserted into a conventional microwave applicator cavity, thereby subdividing it into a shielded region and an unshielded region.

FIG. 4 shows an embodiment of the present invention that utilizes a conventional microwave cavity 80. A partition 82 is placed inside the microwave cavity 80 to shield a portion thereof to form a shielded cavity 84 inside the microwave cavity 82. The partition may be of any convenient, operable configuration.

Figure 5:
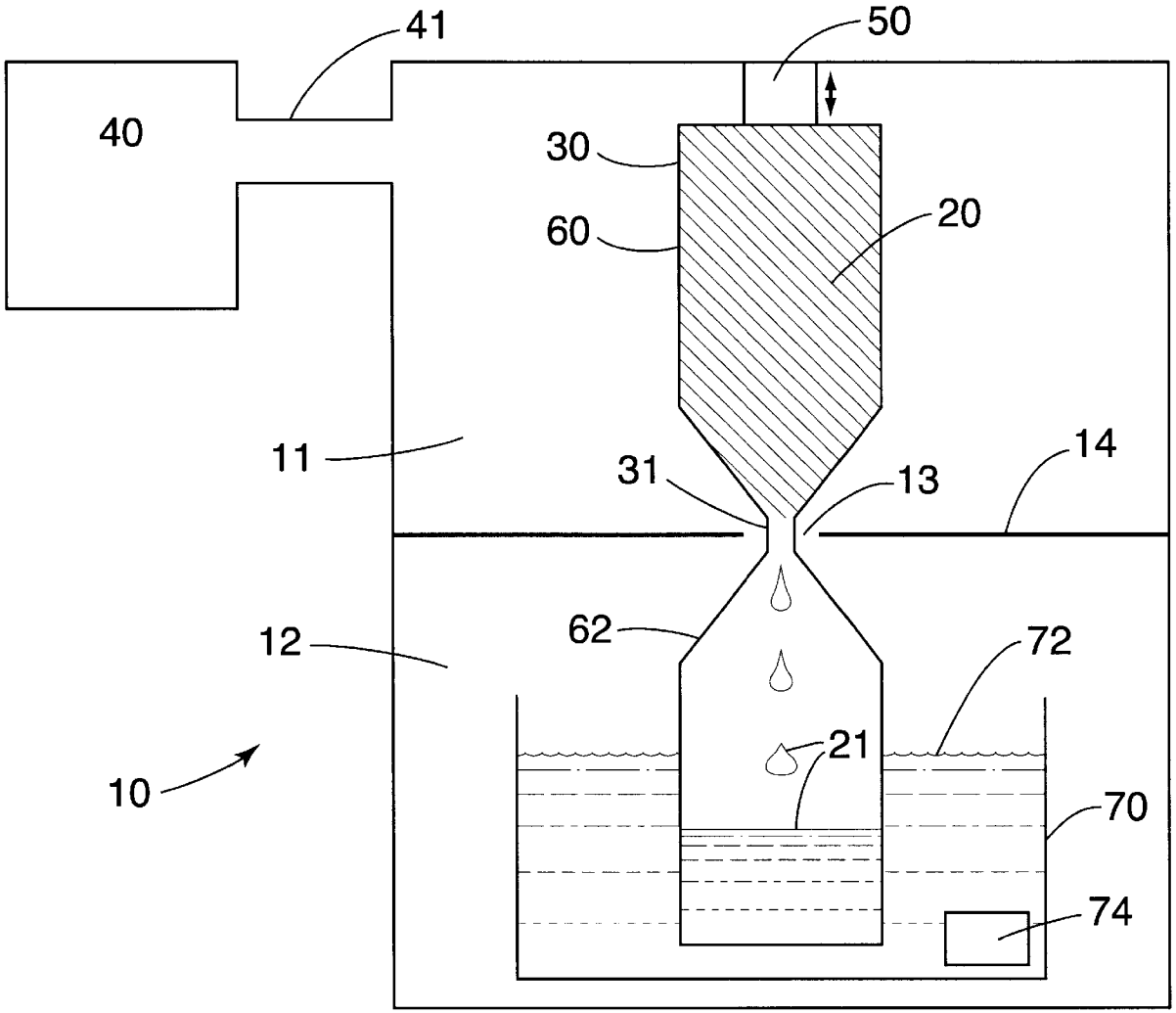
FIG. 5 is a schematic cross-sectional view of an embodiment of the present invention wherein a heated bath is provided within the shielded cavity to maintain the melted material at a selected temperature.
Figure 8:
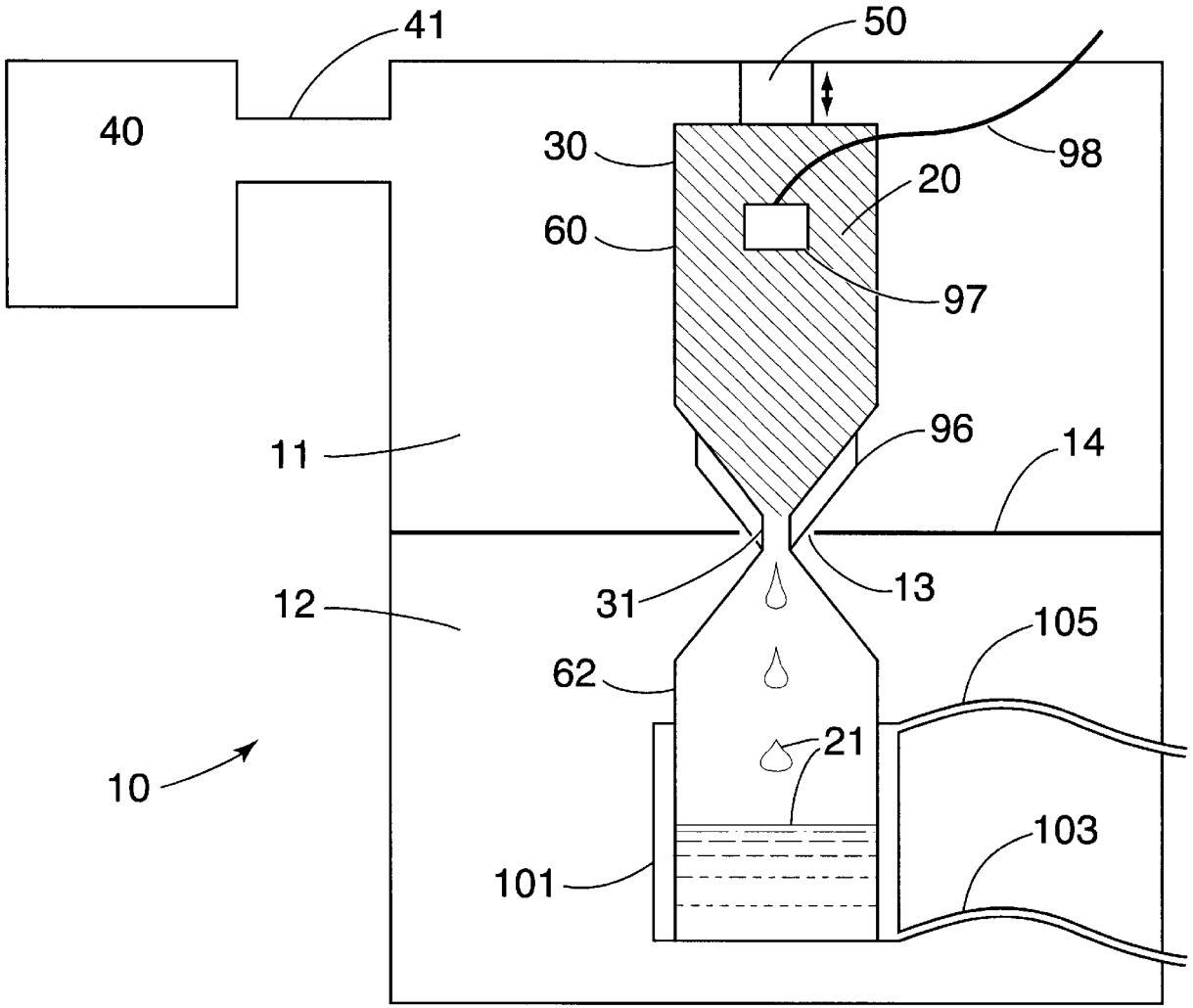
FIG. 8 is a schematic cross-sectional view of an embodiment of the present invention that is similar to that shown in FIG. 1, but with further optional features included.

It may be desirable to further warm the thawed liquid 21 after it has flowed to the shielded cavity (12 or 12'). This warming may be accomplished by allowing a controlled amount of microwave energy to "leak" into the shielded cavity (12 or 12'). Another means of warming the thawed liquid 21 is to immerse the second section 62 of the package 30 in a warmed liquid bath held at a desired temperature. FIG. 5 shows, in addition to the elements shown in FIG. 1, a bath container 70, bath fluid 72, usually water, and a thermostatically controlled heater 74 for holding the bath fluid 72 at a desired temperature. As shown in FIG. 8, a further means of warming the thawed liquid 21 is to employ a circulating fluid jacket 101 with inlet and outlet lines 103, 105. Other conventional heating means may also be used.

Figure 6:
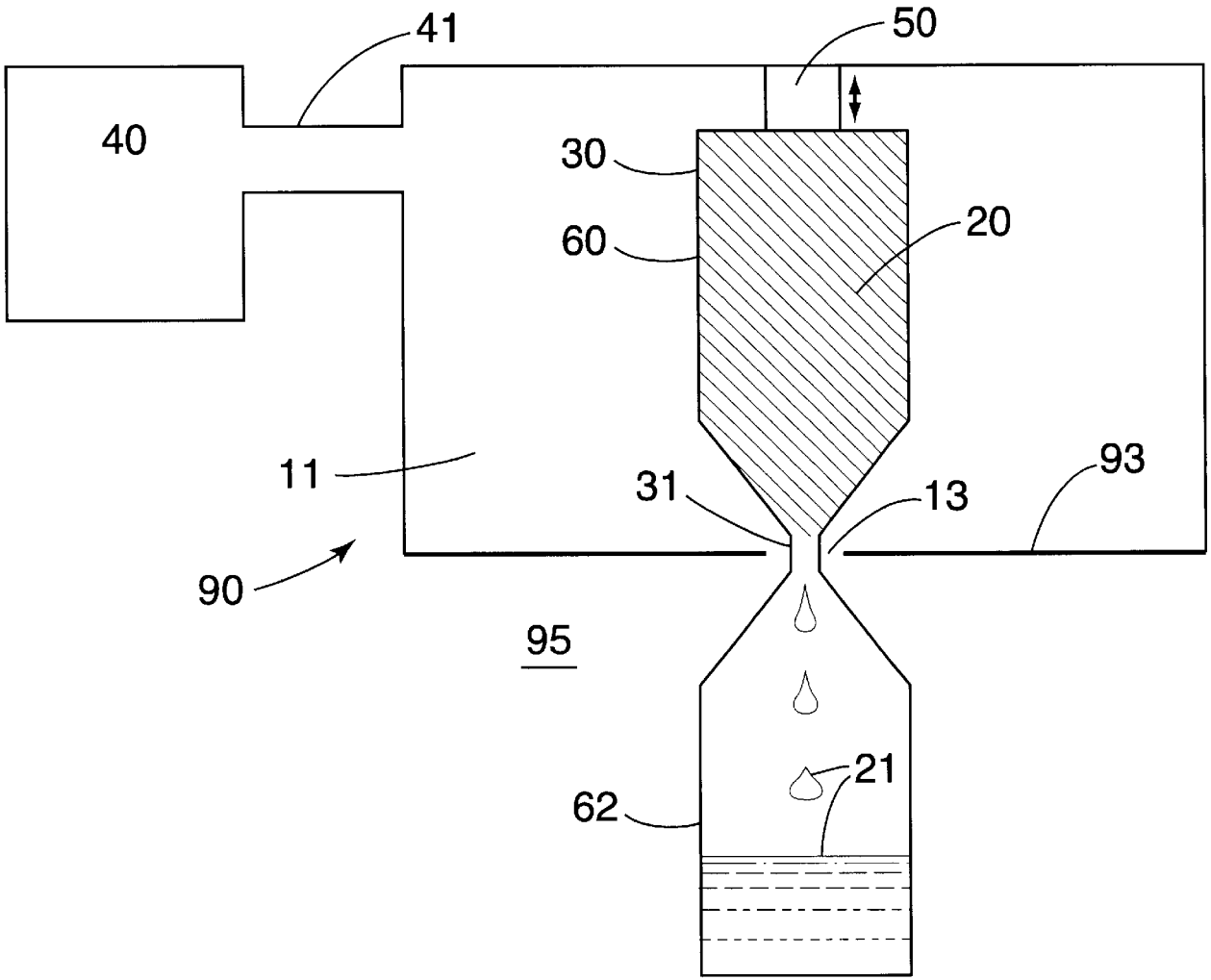
FIG. 6 is a schematic cross-sectional view of an embodiment of the present invention wherein an applicator cavity provides microwave heating while thawed liquid flows outside the applicator cavity to be protected from further heating.

Referring to FIG. 6, another embodiment 90 of the invention is shown. A shielded region 95 may be broadly and simply defined as any volume, space, cavity, enclosure, or structure outside the microwave applicator cavity 11 that may be shielded from the microwave energy applied by the microwave applicator cavity 11. Since microwave applicators are generally contained within a shield, the shielded region can be disposed anywhere outside the shield. A wall 93 of the microwave applicator cavity 11 defines the opening 13, which is described hereinabove.

Figure 7:
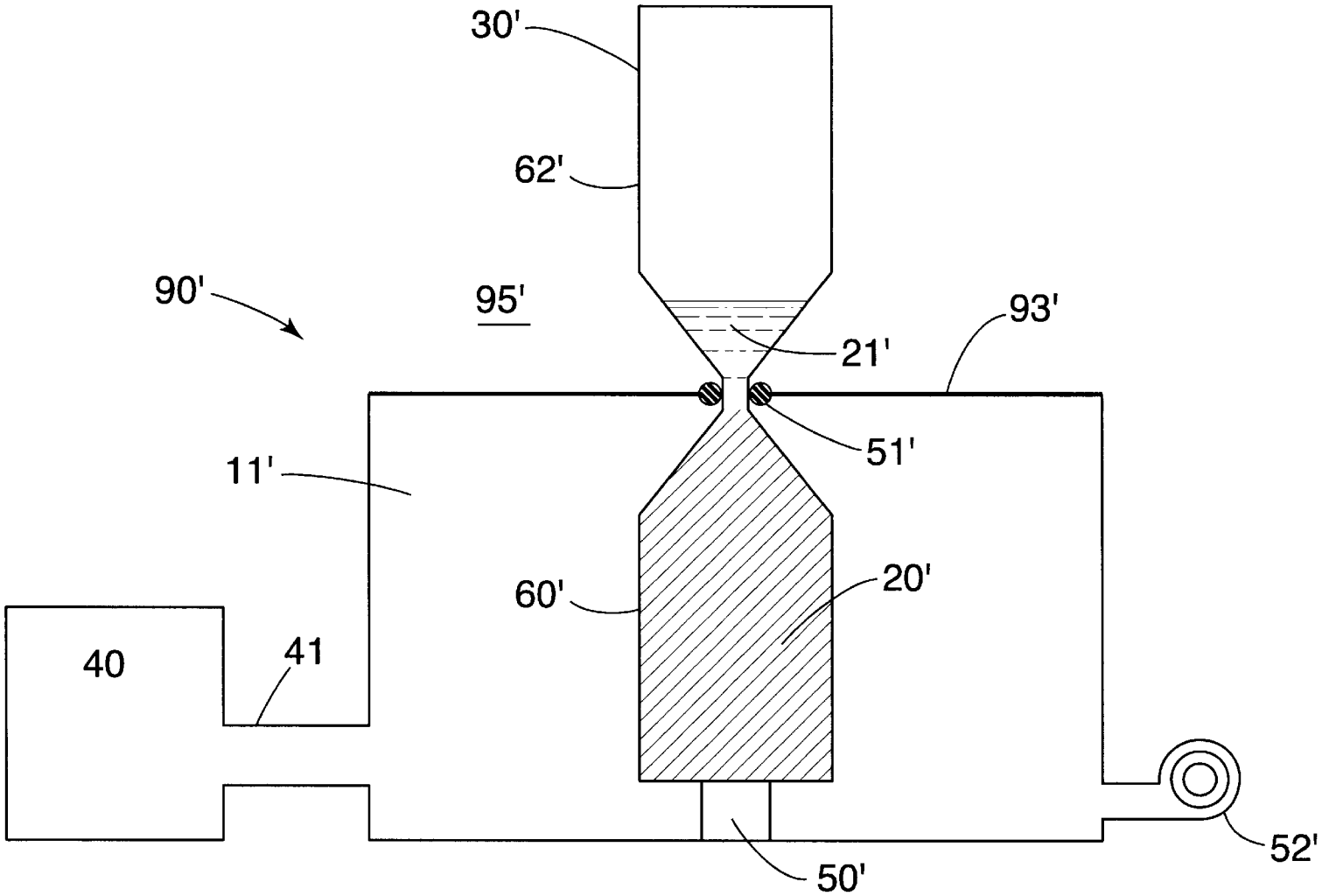
FIG. 7 is a schematic cross-sectional view of an inverted embodiment of the present invention having features similar to the embodiment shown in FIG. 6.

Referring to FIG. 7, a further, inverted embodiment 90' of the invention is shown. A shielded region 95' may be broadly defined as any space outside the microwave applicator cavity 11' that may be shielded from the microwave energy applied by the microwave applicator cavity 11'. A wall 93' of the microwave applicator cavity 11' defines the opening 13, which is described hereinabove.

Referring to FIG. 8, modifications to the apparatus may be helpful in achieving optimal thawing conditions. A supplemental heater 96 may be employed to add extra heat to the first section 60 of the package 30 in the vicinity of the draining means 31 to prevent clogging and enhance free flowing of liquid through draining means 31. The supplemental heater 96 may be comprised of a microwave susceptor, a resistance heater, a fluid bath, a circulating fluid jacket, or other conventional heating means.

FIG. 8 also shows an optional temperature sensor lead 98 with a terminal temperature sensor 97 attached to the first section 60 of the package 30. A temperature sensor 97 can be used in a feedback control system to regulate the microwave heating process. Other temperature sensors (not shown) can be used to regulate supplemental heaters described herein.

Figure 9:
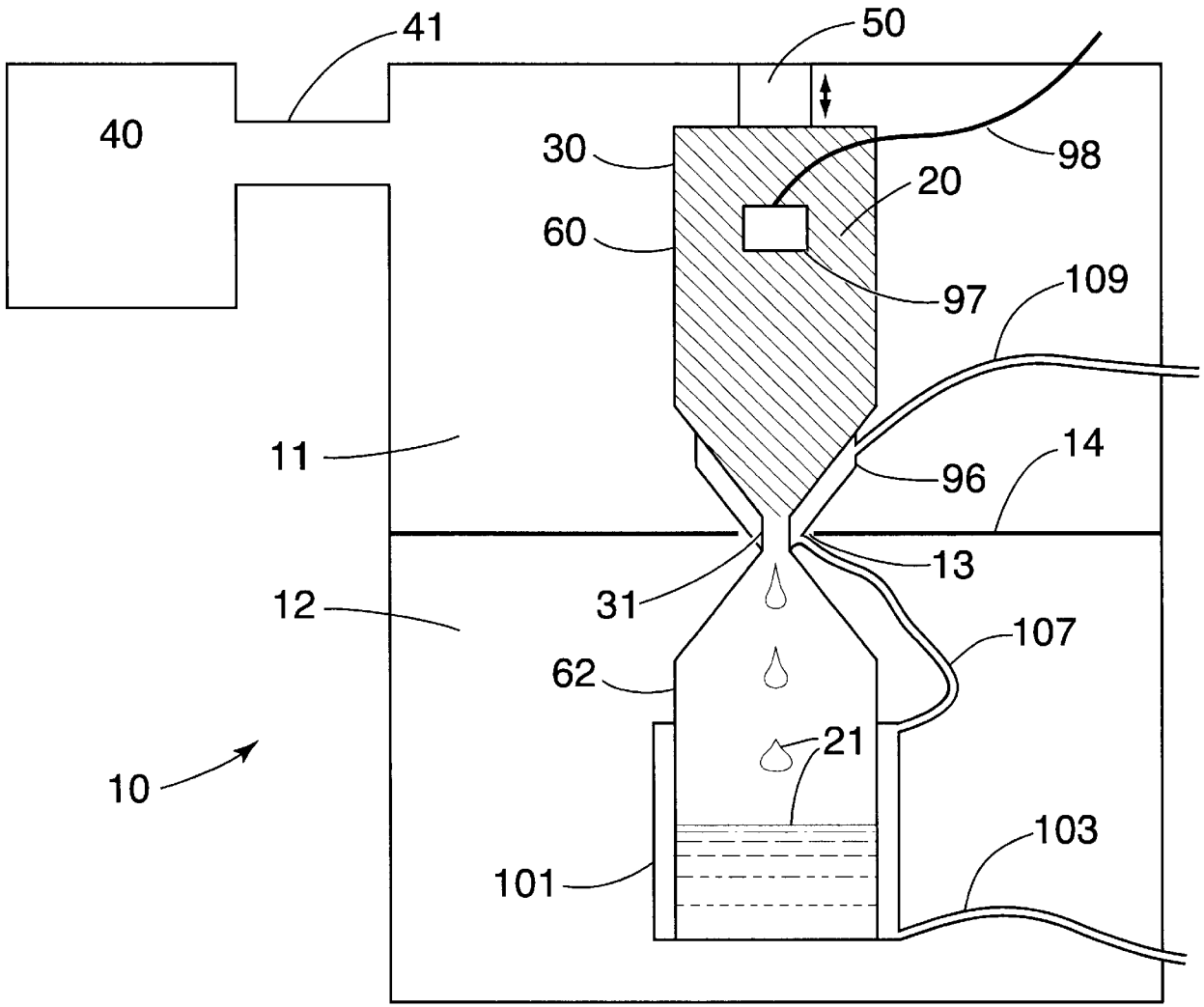
FIG. 9 is a schematic cross-sectional view of an embodiment of the present invention that is similar to that shown in FIG. 8, but with modified optional features.

FIG. 9 shows another modification of the invention wherein both supplemental heaters 96, 101 comprise circulating fluid jackets and share common inlet, cross-flow, and outlet lines 103, 107, 109. An advantage of this embodiment is the use of a single, externally operated and controlled heat source (not illustrated) to provide all of the supplemental heat in the apparatus.

As stated above, the critical objective of any and all embodiments of the invention, including those shown and described above and any other embodiments and/or modifications, is the protection of the thawed liquid 21, 21' from microwave energy applied by the microwave applicator cavity 11, 11', 86 being used to thaw the frozen material 20, 20'.

As will be illustrated in the following examples, the previously described variable frequency microwave heating system can be made much more useful to rapidly thaw frozen materials while preventing damage from localized thermal runaway. A variety of tests were carried out with and without use of a shielded cavity 12 below the microwave applicator cavity 11 to create a more uniform application of power that is less sensitive to variations in the loss characteristics of the workpiece.

EXAMPLE I

A VariWaveTM 1500 variable frequency microwave oven (Lambda Technologies, Inc., Morrisville, N.C.) having a cavity 10"H×10"L×8"D and an operating frequency range of 6.5 to 18 GHz was used to test the present invention. The sample to be melted comprised a polymer bag containing 50 g of a frozen electrolyte solution that simulates the dielectric properties of human blood. With an applied power of approximately 120 W and heating for 50 s, the solution partially thawed, accompanied by overheating of thawed liquid to the point of cooking.

EXAMPLE II

In a system similar to that in the preceding example, a metal plate was inserted in the microwave cavity as illustrated in FIG. 3. The metal plate had a slot in order to accommodate a sealed, two-part bag in which the frozen solution was placed in one half as generally shown and described hereinabove. Conductive metal tape was affixed to the side and rear edges of the plate and conductive sheet metal finger stock was affixed to the front edge of the plate to engage the door when closed, thereby preventing the leakage of microwave energy into the lower part of the cavity. Using this system, all of the frozen solution in the upper bag was successfully thawed while the thawed, liquid solution flowed into the lower cavity and was thereby protected from further heating.

It will be seen from the foregoing that the present invention offers a convenient means for preventing thermal runaway during microwave heating operations in which a material's liquid phase has greater dielectric loss than the solid phase thereof. It will be understood that the terms "melting" and "thawing" as used herein are interchangeable and that the materials to be melted or thawed may be pure, impure, organic and/or inorganic, solutions, mixtures, aggregates, and may have melting temperatures above, at, or below ambient. Solutions may be aqueous, non-aqueous, or polymer based.

It will be further understood that any other electromagnetic energy is applicable to the above description of the invention, for example, RF and IR.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. An apparatus for thawing a frozen material, said apparatus comprising:

an electromagnetic energy source;

an energy applicator which defines a cavity for applying energy from said energy source to a material to be thawed;

a shielded region which is shielded from said energy, said shielded region in fluid communication with said cavity so that thawed material may flow from said cavity into said shielded region;

a container for said material, said container being disposed partly in said cavity and partly in said shielded region so that both frozen and thawed material are contained under substantially hermetic condition; and a maintaining means for maintaining said fluid communication in order to prevent entrapment of fluid in said cavity.

2. An apparatus in accordance with claim 1 wherein said energy source emits microwave energy in a selected frequency range.

3. An apparatus in accordance with claim 2 wherein said selected frequency range comprises a bandwidth of at least +/−5% of a selected center frequency.

4. An apparatus in accordance with claim 2 wherein said frequency range comprises 2.45 GHz +/−50 MHz.

5. An apparatus in accordance with claim 1 wherein said shielded region defines another cavity.

6. An apparatus in accordance with claim 1 wherein said shielded region is at least partially defined by a shield disposed within said cavity.

7. An apparatus in accordance with claim 1 wherein said shielded region is disposed outside said cavity.

8. An apparatus in accordance with claim 1 wherein said maintaining means further comprises a means for mechanically agitating said container to enhance the flow of liquid toward said shielded region.

9. An apparatus in accordance with claim 1 wherein said maintaining means further comprises a means for maintaining a hydrostatic pressure differential between said cavity and said shielded region to further facilitate the flow of liquid toward said shielded region.

10. An apparatus in accordance with claim 1 wherein said shielded region further comprises a supplemental heating means for maintaining a desired temperature in at least a portion of said shielded region.

11. An apparatus in accordance with claim 10 wherein said supplemental heating means comprises a controlled leakage of energy from said cavity into said shielded region.

12. An apparatus in accordance with claim 10 wherein said supplemental heating means comprises at least one of the group consisting of a temperature-controlled fluid bath, a resistance heater, and a circulating liquid jacket.

13. An apparatus in accordance with claim 1 further comprising a means for measuring the temperature of said material during processing.

14. An apparatus in accordance with claim 1 wherein said maintaining means further comprises a supplemental heating means for providing supplemental heat to the material in order to maintain said fluid communication.

15. An apparatus in accordance with claim 14 wherein said supplemental heating means comprises at least one of the group consisting of an energy absorber, temperature-controlled fluid bath, a resistance heater, and a circulating fluid jacket.

16. An apparatus for thawing a material, said apparatus comprising:

a multimode microwave applicator cavity;

a microwave source adapted for sweeping the frequency of microwave energy introduced into said cavity over a usable bandwidth of at least +/−2% of a center frequency so that the microwave power density within said cavity is substantially uniform; and a shielded region which is shielded from said microwave source, said shielded region in fluid communication with said cavity so that thawed material may flow from said cavity into said shielded region;

a container for said material, said container being disposed partly in said cavity and partly in said shielded region so that both frozen and thawed material are contained under substantially hermetic condition; and a maintaining means for maintaining said fluid communication in order to prevent entrapment of fluid in said cavity.

17. An apparatus in accordance with claim 16 wherein said bandwidth covers at least +/−5% of a selected center frequency.

18. An apparatus in accordance with claim 16 wherein said microwave frequency covers a bandwidth of 2.45 GHz +/−50 MHz.

19. An apparatus in accordance with claim 16 wherein said shielded region defines a second cavity.

20. An apparatus in accordance with claim 16 wherein said shielded region is at least partially defined by a microwave shield disposed within said cavity.

21. An apparatus in accordance with claim 16 wherein said shielded region is disposed outside said cavity.

22. An apparatus in accordance with claim 16 wherein said maintaining means further comprises a means for mechanically agitating said container to enhance the flow of liquid toward said shielded region.

23. An apparatus in accordance with claim 16 wherein said maintaining means further comprises a means for maintaining a hydrostatic pressure differential between said first and second cavities to further facilitate the flow of liquid toward said shielded region.

24. An apparatus in accordance with claim 16 wherein said shielded region further comprises a supplemental heating means for maintaining a desired temperature in at least a portion of said shielded region.

25. An apparatus in accordance with claim 24 wherein said supplemental heating means comprises a controlled leakage of microwave energy from said cavity into said shielded region.

26. An apparatus in accordance with claim 24 wherein said supplemental heating means comprises at least one of the group consisting of a temperature-controlled fluid bath, a resistance heater, and a circulating liquid jacket.

27. An apparatus in accordance with claim 16 further comprising a means for measuring the temperature of said material during processing.

28. An apparatus in accordance with claim 16 wherein said maintaining means further comprises a supplemental heating means for providing supplemental heat to the material in order to maintain said fluid communication.

29. An apparatus in accordance with claim 28 wherein said supplemental heating means comprises at least one of the group consisting of a microwave absorber, temperature-controlled fluid bath, a resistance heater, and a circulating fluid jacket.

30. A method of thawing a selected material comprising the steps of:

a. providing an electromagnetic energy source; an energy applicator which defines a cavity for applying energy from said energy source to a material to be thawed; and a shielded region which is shielded from said energy source, said shielded region in fluid communication with said cavity so that thawed material may flow from said cavity into said shielded region;

b. placing a material to be thawed into said cavity, said material being contained within a sealed container that is disposed partly in said cavity and partly in said shielded region so that both frozen and thawed material a contained under substantially hermetic condition;

c. introducing electromagnetic energy into said cavity to thaw said material so that thawed liquid flows from said cavity into said shielded region; and d. maintaining said fluid communication in order to prevent entrapment of fluid in said cavity.

31. A method in accordance with claim 30 wherein said energy source emits microwave energy in a selected frequency range.

32. A method in accordance with claim 31 wherein said selected frequency range comprises a bandwidth of at least +/−5% of a selected center frequency.

33. A method in accordance with claim 31 wherein said frequency range comprises 2.45 GHz +/−50 MHz.

34. A method in accordance with claim 30 wherein said shielded region defines a second cavity.

35. A method in accordance with claim 30 wherein said shielded region is at least partially defined by a shield disposed within said cavity.

36. A method in accordance with claim 30 wherein said shielded region is disposed outside said cavity.

37. A method in accordance with claim 30 wherein step d further comprises mechanically agitating said container in order to enhance the flow of liquid toward said shielded region.

38. A method in accordance with claim 30 wherein step d further comprises maintaining a hydrostatic pressure differential between said first and second cavities in order to further facilitate the flow of liquid toward said shielded region.

39. A method in accordance with claim 30 wherein step c further comprises providing supplemental heat to said shielded region in order to maintain a desired temperature in at least a portion of said shielded region.

40. A method in accordance with claim 39 wherein said providing step comprises allowing a controlled leakage of energy from said cavity into said shielded region.

41. A method in accordance with claim 39 wherein said providing step comprises using at least one of the group consisting of a temperature-controlled fluid bath, a resistance heater, and a circulating liquid jacket.

42. A method in accordance with claim 30 wherein step c further comprises measuring the temperature of said material during processing.

43. A method in accordance with claim 30 wherein step d further comprises providing supplemental heat to the material in order to maintain said fluid communication.

44. A method in accordance with claim 43 wherein said providing step comprises using at least one of the group consisting of an energy absorber, temperature-controlled fluid bath, a resistance heater, and a circulating fluid jacket.

45. A method of thawing a selected material comprising the steps of:

a. providing a multimode microwave applicator cavity; a microwave source adapted for sweeping the frequency of microwave energy introduced into said cavity over usable bandwidth of at least +/−2% of a center frequency so that the microwave power density within said cavity is substantially uniform; and a shielded region which is shielded from said microwave source, said shielded region in fluid communication with said cavity so that thawed material may flow from said cavity into said shielded region;

b. placing a material to be thawed into said cavity, said material being contained within a sealed container that is disposed partly in said cavity and partly in said shielded region so that both frozen and thawed material are contained under substantially hermetic condition;

c. introducing microwave energy into said cavity to thaw said material so that thawed liquid flows from said cavity into said shielded region; and d. maintaining said fluid communication in order to prevent entrapment of fluid in said cavity.

46. A method in accordance with claim 45 wherein said selected frequency range comprises a bandwidth of at least +/−5% of a selected center frequency.

47. A method in accordance with claim 45 wherein said frequency range comprises 2.45 GHz +/−50 MHz.

48. A method in accordance with claim 45 wherein said shielded region defines a second cavity.

49. A method in accordance with claim 45 wherein said shielded region is at least partially defined by a microwave shield disposed within said cavity.

50. A method in accordance with claim 45 wherein said shielded region is disposed outside said cavity.

51. A method in accordance with claim 45 wherein step d further comprises mechanically agitating said container in order to enhance the flow of liquid toward said shielded region.

52. A method in accordance with claim 45 wherein step d further comprises maintaining a hydrostatic pressure differential between said first and second cavities in order to further facilitate the flow of liquid toward said shielded region.

53. A method in accordance with claim 45 wherein step c further comprises providing supplemental heat to said shielded region in order to maintain a desired temperature in at least a portion of said shielded region.

54. A method in accordance with claim 53 wherein said providing step comprises allowing a controlled leakage of microwave energy from said cavity into said shielded region.

55. A method in accordance with claim 53 wherein said providing step comprises using at least one of the group consisting of a temperature-controlled fluid bath, a resistance heater, and a circulating liquid jacket.

56. A method in accordance with claim 45 wherein step c further comprises measuring the temperature of said material during processing.

57. A method in accordance with claim 45 wherein step d further comprises providing supplemental heat to the material in order to maintain said fluid communication.

58. A method in accordance with claim 57 wherein said providing step comprises using at least one of the group consisting of a microwave absorber, temperature-controlled fluid bath, a resistance heater, and a circulating fluid jacket.

* * * * *